US007732686B2

(12) United States Patent
Yamaguchi

(10) Patent No.: US 7,732,686 B2
(45) Date of Patent: Jun. 8, 2010

(54) STOPPER FOR KEYBOARD-BASED MUSICAL INSTRUMENTS

(75) Inventor: Tsutomu Yamaguchi, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 11/628,254

(22) PCT Filed: May 24, 2005

(86) PCT No.: PCT/JP2005/009440

§ 371 (c)(1),
(2), (4) Date: Sep. 17, 2007

(87) PCT Pub. No.: WO2005/119644

PCT Pub. Date: Dec. 15, 2005

(65) Prior Publication Data

US 2008/0127807 A1 Jun. 5, 2008

(30) Foreign Application Priority Data

Jun. 4, 2004 (JP) ..... 2004-167756

(51) Int. Cl.
*G10C 3/18* (2006.01)

(52) U.S. Cl. ..... 84/236; 84/243

(58) Field of Classification Search ..... 84/436, 84/236, 243

See application file for complete search history.

(56) References Cited

U.S. PATENT DOCUMENTS

| | | | | | |
|---|---|---|---|---|---|
| 5,444,181 | A | * | 8/1995 | Wada et al. | 84/719 |
| 5,741,995 | A | * | 4/1998 | Kawamura et al. | 84/721 |
| 6,011,214 | A | * | 1/2000 | Kawamura | 84/719 |

FOREIGN PATENT DOCUMENTS

| | | | |
|---|---|---|---|
| JP | 6-12060 | | 1/1994 |
| JP | 6-180583 | | 6/1994 |
| JP | 2001-337668 | | 12/2001 |
| JP | 2003-195853 | | 7/2003 |
| JP | 2003195853 | A * | 7/2003 |
| JP | 2004-037484 | | 2/2004 |

* cited by examiner

*Primary Examiner*—Jianchun Qin
(74) *Attorney, Agent, or Firm*—Crowell & Moring LLP

(57) ABSTRACT

A stopper for a keyboard-based musical instrument is provided for accomplishing a good stopping feeling of a pivotable member, thereby making it possible to improve a touch feeling and restrain collision noise and other noise. A stopper 7 for a keyboard-based musical instrument with which a pivotable member 6 comes into contact while said pivotal member pivotally moves in association with a key touch, thereby restraining the pivotal movement of said pivotable member 6, comprises a mass 26, a first cushion 25 laminated on a front side of said mass 26, and a second cushion 27 laminated on a back side of said mass 26. Preferably, the mass 26 is made of a metal, and the first cushion 25 is harder than the second cushion 27.

6 Claims, 3 Drawing Sheets

STOPPER FOR KEYBOARD-BASED MUSICAL INSTRUMENTS

TECHNICAL FIELD

The present invention relates to a stopper for keyboard-based musical instruments for restricting swinging pivotal movements of pivotable members such as a hammer and a key which pivotally move to the accompaniment of a key touch.

BACKGROUND ART

Conventionally, a stopper for keyboard-based musical instruments of this type is known, for example, from Patent Document 1. This stopper is used in an upright piano which is equipped with a silence function, where the stopper is arranged between a string and a hammer and attached along a pivotal shaft which extends in a direction in which keys are arranged side by side. This pivotal shaft is attached to a piano case. The stopper is composed of a hard cushion, a soft cushion, and an extremely soft cushion, which are laminated one on another, arranged in this order from the pivotal shaft. The hammer is configured to pivotally move toward a string through a wippen and a jack which pivotally move to the accompaniment of a key touch.

With the foregoing configuration, when a silent play is performed, the pivotal shaft is rotated to place the extremely soft cushion of the stopper in opposition to the hammer. As the key is touched in this state, the hammer comes into contact with the extremely soft cushion of the stopper when it arrives at a predetermined pivotal angle before the jack comes off. Thus hammer thus brought into contact with the extremely soft cushion compresses the extremely soft, soft, and hard cushions, while it is braked by them, thereby preventing the hammer from striking the string. Also, collision noise generated when the hammer comes into contact with the stopper is reduced by the cushions.

However, since the conventional stopper is composed of three, i.e., extremely soft, soft, and hard cushions, the plurality of cushions including the extremely soft cushion significantly displace when a large impact is applied by the hammer coming into contact from the time the hammer touches the stopper to the time it stops. Also, when the hammer comes into contact with the cushion, a cushion compressed feeling is transmitted to a finger tip of a player who feels as if he pushes the finger into sponge, because the jack has not yet come off, thus failing to provide the player with a good hammer striking feeling and stopping feeling, with a resulting damage to a touch feeling. For eliminating such an inconvenience, it is contemplated to employ a hard cushion for the stopper to reduce the amount of displacement thereof. In this event, however, large collision noise occurs when the hammer comes into contact with the hard cushion. In addition, since vibrations associated with the collision are transmitted to a case through the hard cushion and pivotal shaft, noise can be generated.

The present invention has been made to solve the problem mentioned above, and it is an object of the invention to provide a stopper for a keyboard-based musical instrument which is capable of improving a touch feeling and restraining collision noise and other noise by accomplishing a good stop feeling of a pivotable member.

Laid-open Japanese Patent Application No. 6-180583.

DISCLOSURE OF THE INVENTION

To achieve this object, the invention according to the present invention is a stopper for a keyboard-based musical instrument with which a pivotable member comes into contact while the pivotal member pivotally moves in association with a key touch, thereby restraining the pivotal movement of the pivotable member, characterized by comprising a mass, a first cushion laminated on a front side of the mass, and a second cushion laminated on a back side of the mass.

This stopper for a keyboard-based musical instrument is composed of the first and second cushions laminated one on the other, and the mass sandwiched between them. As a key is touched, the pivotable member pivotally moves into contact with the first cushion of the stopper. In this specification, the mass refers to an object made of a material which has a relatively high rigidity and specific gravity. In this way, even if the stopper is applied with a large impact caused by the pivotable member coming into contact, the highly rigid mass hardly deflects, so that the impact distributes over a wide area of the second cushion through the mass as it is transmitted. As a result, even if the second cushion is soft, it is substantially free from local recesses, so that the second cushion is significantly reduced in the amount of displacement. Also, since the mass hardly deflects, a displacement (intrusion) on the back side of the first cushion is restrained by the mass even if the second cushion is soft. As a result, the first cushion is reduced in the amount of displacement as well. As described above, both the first and second cushions displace by reduced amounts when the pivotable member comes into contact, the amount of displacement, exhibited by the entire stopper, can also be made smaller than before. Consequently, a good stopping feeling of the pivotable member can be provided, thereby improving a touch feeling.

Also, the mass is characteristically less prone to vibrations due to its high specific gravity and large weight. As such, vibrations associated with a collision of the pivotable member is restrained from transmitting to the second cushion. From the foregoing, vibrations can be prevented from transmitting to the case of the keyboard-based musical instrument through the second cushion, thus restraining noise.

The invention according to claim 2 is characterized in that the mass is made of a metal in the stopper for a keyboard-based musical instrument according to claim 1.

According to this configuration, since the mass is made of a metal, it is possible to readily provide a mass which has a high rigidity and specific gravity. Also, the material cost of the mass can be reduced by selecting an inexpensive metal.

The invention according to claim 3 is characterized in that the first and second cushions are different in hardness from each other in the stopper for a keyboard-based musical instrument according to claim 1 or 2.

According to this configuration, desired cushion characteristics can be tailored by selecting the hardness of the first and second cushions as appropriate.

The invention according to claim 4 is characterized in that the first cushion is harder than the second cushion in the stopper for a keyboard-based musical instrument according to claim 3.

According to this configuration, since the first cushion placed on the side with which the pivotable member comes into contact is harder than the second cushion, a good stopping feeling of the pivotable member can be ensured without producing a spring feeling by virtue of a reduction in the amount of displacement of the first cushion. This can result in a firm good touch feeling. Also, since vibrations associated with a collision can be sufficiently absorbed by the softer second cushion, the vibrations can be prevented from transmitting to the case of the keyboard-based musical instrument through the second cushion, thus restraining noise. In addition, as described above, the first cushion is restrained from deflecting by the mass interposed between both the cushions even though the second cushion is soft, so that a good touch feeling can be ensured without impeding the aforementioned advantages resulting from the hard first cushion.

The invention according to claim 5 is characterized by further comprising a felt adhered on a surface closer to the first cushion a stopper for a keyboard-based musical instrument according to any of claims 1 to 4.

According to this configuration, since the pivotable member comes into contact with the felt, collision noise can be restrained when the pivotable member comes into contact with the stopper.

The invention according to claim 6 is characterized in that the first and second cushions and the mass extend in a direction in which the pivotable members are arranged side by side in the stopper for a keyboard-based musical instrument according to any of claims 1 to 5.

According to this configuration, an impact to the stopper by the pivotable member can be supported by the entirety of the first and second cushions and mass which extends in the direction in which the pivotable members are arranged side by side, thereby further reducing the amount of displacement of the stopper and further improving the stopping feeling. Also, as compared with a stopper provided for each pivotable member, the number of parts and the number of assembling steps are largely reduced, thus making it possible to reduce the manufacturing cost of the keyboard-based musical instrument.

BEST MODE FOR CARRYING OUT THE INVENTION

Figure 1:
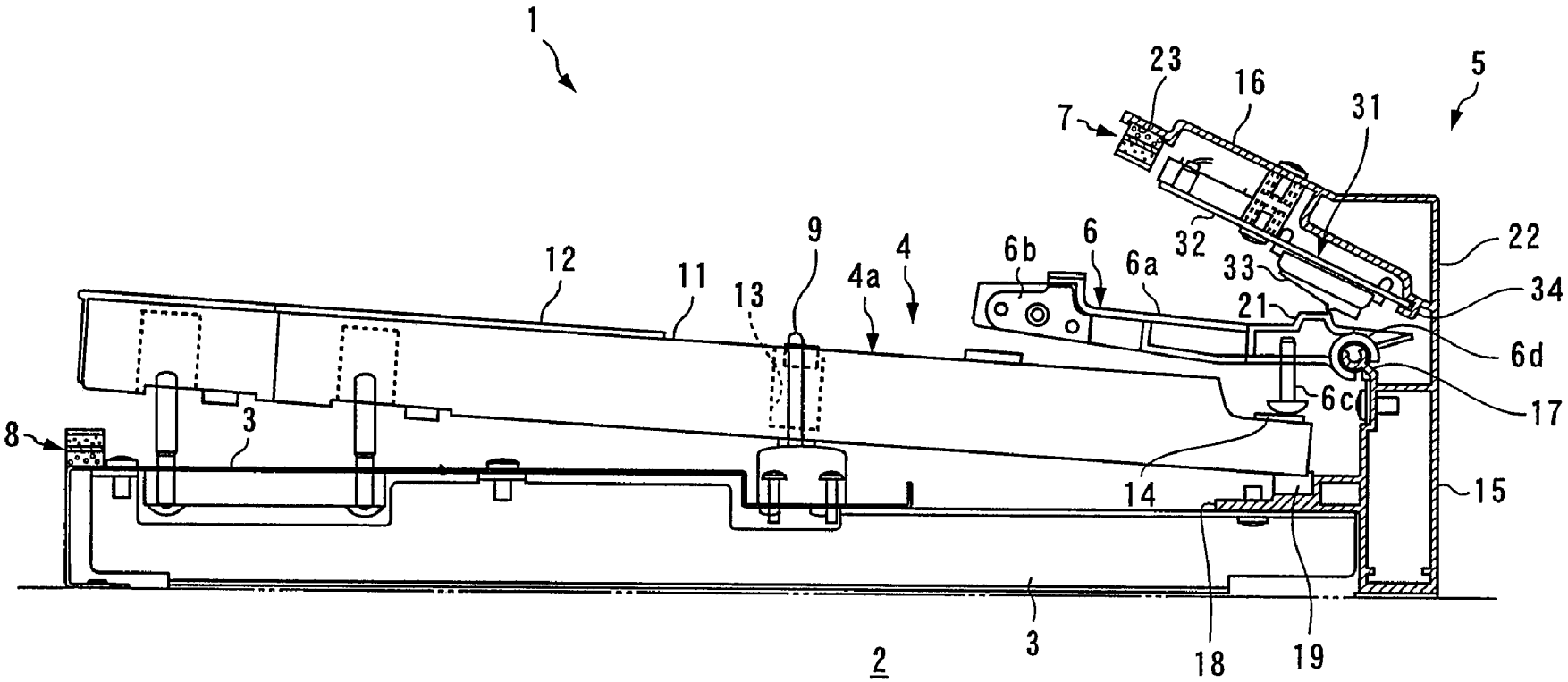
[FIG. 1] A lateral sectional view illustrating a keyboard device which comprises a stopper of the present invention in a key released state.

In the following, a preferred embodiment of the present invention will be described in detail with reference to the drawings. FIG. 1 illustrates a keyboard device of an electronic piano in a key released state. This keyboard device 1 comprises a keyboard chassis 3 disposed on a horizontal keybed 2; a plurality of keys 4 (pivotable members) pivotably supported by the keyboard chassis 3; an action chassis 5 disposed behind (on the right side in FIG. 1) of the keyboard chassis 3; a plurality of hammers 6 (pivotable members) and hammer stoppers 7 (stoppers) attached to the action chassis 5; and a front key stopper 8 (stepper) attached to the keyboard chassis 3.

The keyboard chassis 3 is composed of stamped and bent steel plates which are assembled into the keyboard chassis 3, and is fixed on the keybed 2. A plurality of balance pins 9 are implanted such that they are arranged side by side in a left-to-right direction (depth direction in FIG. 1) at the center of a front-to-rear direction of the keyboard chassis 3.

A plurality of keys 4 includes a plurality of white keys 4*a* and black keys (not shown), each of which is composed of a key body 11 which extends in the front-to-rear direction, and a key cover 12 which is attached to its surface in a front half area. A balance pin hole 13 is formed at the center of the key body 11 in the front-to-rear direction to extend through the key body 11 in the vertical direction. The key 4 is pivotably supported by the balance pin 9 through this balance pin hole 13. An upper portion of the rear end of the key body 11 is cut out, and a sheet-shaped felt 14 is adhered to the bottom of this cutout.

The action chassis 5 is disposed immediately behind the keyboard chassis 3, extends in the left-to-right direction over all the keys 4, and fixed to the keybed 2. Also, the action chassis 5 is formed of an extrusion molding made of a metal material such as aluminum in a hollow shape, and integrally comprises a hammer support 15 for supporting the hammer 6, and a stopper mount 16 for mounting the hammer stopper 7 thereon.

The hammer support 15 has a rectangular cross-section longer in the vertical direction, and is formed with an arcuate hammer fulcrum 17 which protrudes diagonally upward at an upper front end. A step shaped key carrier 18 is provided at the center of the hammer support 15 in the vertical direction to protrude in front. The key carrier 18 has a front end screwed to the keyboard chassis 3, and a rear key stopper 19 is adhered on the top surface of the key carrier 18 in a central area. This rear key stopper 19 comprises one strip-shaped felt which continuously extends in the left-to-right direction over all the keys 4.

The hammer 6 is provided for each key 4, and comprises a rod-shaped hammer body 6*a* made of a synthetic resin; a weight 6*b* attached to the hammer body 6*a*; an adjusting screw 6*c*; and the like. The hammer body 6*a* is formed with an arcuate engagement groove 6*d* in a rear end area, such that the hammer 6 is pivotably supported by the hammer support 15 of the action chassis 5 with the engagement groove 6*d* in engagement with the hammer fulcrum 17. The weight 6*b* comprises a steel plate or the like, and attached to front end areas on both left and right sides of the hammer body 6*a* (only one is shown). The adjusting screw 6*c* is provided for adjusting a relative angle of the hammer 6 to the key 4, and is screwed into the lower surface of the hammer body 6*a* in such a manner that it can advance thereinto and retract therefrom. The hammer 6 is in contact with a rear end area of the key 4 corresponding thereto from above through the adjusting screw 6*c* and felt 14. Also, a switch pusher 21 is disposed on the top surface of the hammer body 6*a* at a position immediately before the engagement groove 6*d* such that it protrudes therefrom.

Figure 2:
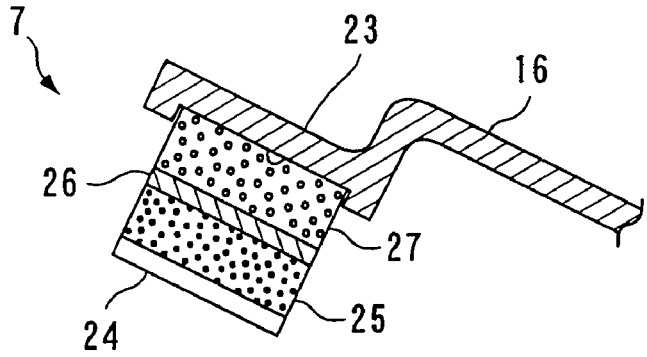
[FIG. 2] A partially enlarged lateral sectional view illustrating a hammer stopper and its surroundings.

The stopper mount 16 of the action chassis 5 extends in front diagonally upward from the upper end of the hammer support 15 through a back wall 22. As illustrated in FIG. 2, a shallow recess 23 is formed in the lower surface of the stopper mount 16 in a front end area, and the hammer stopper 7 is mounted in the recess 23.

The hammer stopper 7 is composed of a felt 24, a first cushion 25, a mass 26, and a second cushion 27. These components 24-27 are each made of a single strip-shaped material which continuously extends over all the keys 4 in a direction in which the keys are arranged side by side, and are laminated in the order mentioned above, and adhered to each other. Then, the hammer stopper 7 is mounted to stopper mount 16 with its second cushion 27 partially fitted in and adhered to the recess 23 of the stopper mount 16. The mass 26 is made of a metal plate having a relatively high rigidity and specific gravity, for example, a steel plate. Either of the first cushion 25 and second cushion 27 is made of foamed urethane. The first cushion 25 exhibits a lower degree of foaming and is made harder as compared with the second cushion 27.

Figure 4:
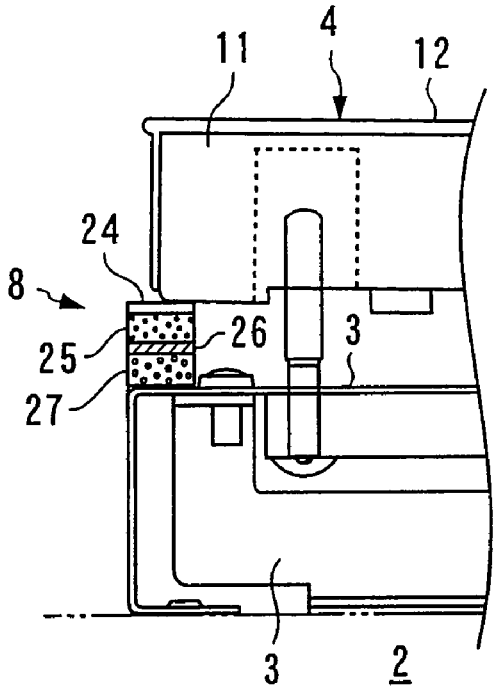
[FIG. 4] A partial lateral sectional view illustrating a front end portion of the keyboard device of FIG. 1 in a key touched state.

The front key stopper 8 is made of a single strip-shaped material having completely the same configuration as the hammer stopper 7 mentioned above. As illustrated in FIG. 4, this front key stopper 8 is adhered to the top surface of the keyboard chassis 3 in a front end area with the felt 24 oriented upward, extends over all the keys 4 in the direction in which the keys 4 are arranged side by side, such that the front ends of the keys 4 oppose the felt 24 in a key released state.

Also, a key switch 31 is provided in the stopper mount 16 of the action chassis 5. The key switch 31 is provided to detect key touch information on the corresponding key 4 through the hammer 6, and comprises a switch board 32, and a switch body 33 disposed on the switch body 32 for each key 4. An engagement recess 34 is formed in a proximal end of the stopper mount 16, and the key switch 31 is fixed to the stopper mount 16 with screws with the rear end of the switch board 32 inserted into the engagement recess 34. In a key released state, switch body 33 opposes the switch pusher 21 of the hammer 4 positioned therebelow.

Figure 3:
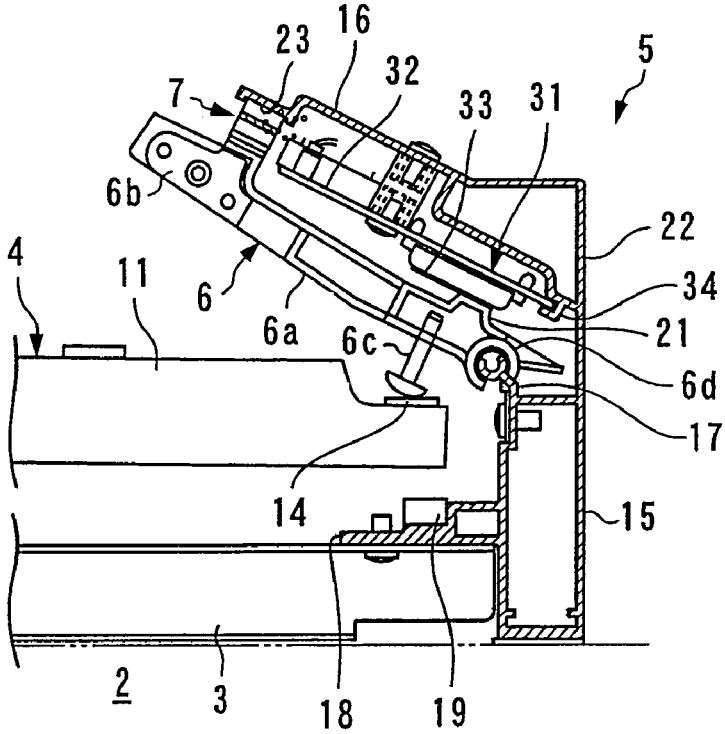
[FIG. 3] A partial lateral sectional view illustrating a rear end portion of the keyboard device of FIG. 1 in a key touched state.

Next, the operation of the keyboard device in the configuration described above will be described with reference to FIGS. 1 and 3. In the key released state illustrated in FIG. 1, the key 4 is carried on the rear key stopper 19 while it is urged downward by the weight of the hammer 6 at the rear end thereof through the adjusting screw 6*c*. As the key is touched from this key released state, the key 4 pivotally moves about the balance pin 9 in the counter-clockwise direction in FIG. 1. Associated with this pivotal movement, the key 4 pushes up the hammer 6 through the adjusting screw 6*c*, causing the hammer 6 to pivotally moves in the clockwise direction about the hammer fulcrum 17. As illustrated in FIG. 3, when the hammer 6 has arrived at a predetermined pivotal angle, it comes into contact with the hammer stopper 7, and is therefore restrained from pivotally moving. Also, substantially at the same time as the hammer 6 coming into contact with the hammer stopper 7, the front end of the key 4 comes into contact with the front key stopper 8, thus restraining the key 4 from pivotally moving (see FIG. 4).

The switch pusher 21 pushes the switch body 33 of the key switch 31 halfway in the pivotal movement of the hammer 6 to detect key touch information on the key 4, causing a controller, not shown, to control sound generation of the electronic piano in accordance with the detected key touch information.

As the key 4 is released from the key touched state, the key 4 and hammer 6 pivotally move in opposite directions to the above, respectively, to return to the key released state illustrated in FIG. 1.

According to this embodiment, as described above, when the hammer 6 comes into contact with the hammer stopper 7 in association with a key touch, causing a large impact to be applied to the hammer stopper 7, the highly rigid mass 26 made of steel hardly deflects, so that the impact is distributed in its transmission over the wide area of the softer second cushion 27 through the mass 26. As a result, the second cushion 27 is substantially free from local recesses, thus making it possible to largely reduce the amount of displacement of the second cushion 27. Also, since the first cushion 25 is restrained from deflecting by the mass 26, the first cushion 25 is also reduced in the amount of displacement. Further, since the hammer 6 comes into contact with the hard first cushion 25, a good stopping feeling can be ensured without producing a spring feeling. In the following manner, the mass 26 arranged between both cushions 25, 27 reduces the amounts of displacement of both the first and second cushions 25, 27 when the hammer 6 comes into contact with the hammer stopper 7, thus making it possible to largely reduce the amount of displacement of the entire hammer stopper 7 to provide a good stopping feeling and an impacting feeling of the hammer 6 and improve the touch feeling.

Also, since any of the first cushion 25, mass 26, and second cushion 27 continuously extends over all the keys 4, an impact caused by each hammer 6 coming into contact can be supported by the entire hammer stopper 7. This can further reduce the amount of displacement of the hammer stopper 7 and further improve the stopping feeling of the hammer 6. Also, as compared with the hammer stopper 7 provided for each hammer 6, the number of parts and the number of assembling steps are largely reduced, thus making it possible to reduce the manufacturing cost of electronic pianos.

Also, since the mass 26 does not easily vibrate due to its high specific gravity, vibrations associated with the collision of the hammer 6 is less likely to be transmitted to the second cushion 27. Also, vibrations transmitted to the second cushion 27 is sufficiently absorbed by the second softer cushion 27. Thus, vibrations can be sufficiently restrained from being transmitted to the action chassis 5 through the second cushion 27, thereby restraining noise. The hammer 6 can also restrain collision sound when it cones into contact with the hammer stopper 7 because the hammer 6 comes into contact with the felt 24. In the foregoing manner, it is possible to simultaneously provide two effects, i.e., an improved touch feeling, and restrained collision noise and other noise. Also, as described above, the front key stopper 8 is the same as the hammer stopper 7 in configuration, it can provide the aforementioned effects produced by the hammer stopper 7. Particularly, a good stopping feeling of the key 4 can be accomplished when the key 4 comes into contact with the front key stopper 8 when the key 4 is touched.

Figure 5:
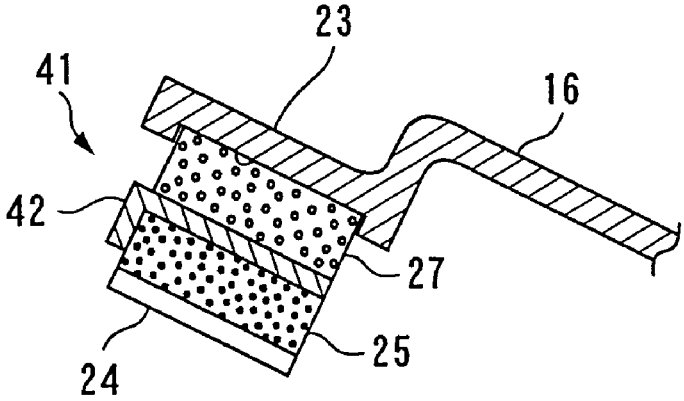
[FIG. 5] A partial lateral sectional view illustrating an exemplary modification to the hammer stopper of FIG. 2.

FIG. 5 illustrates an exemplary modification to the stoppers 7, 8 described above in regard to the hammer stopper. In this hammer stopper 41, a mass 42 made of a steel plate has its front end area bent downward at a right angle to have an L-shaped cross-section. The remaining configuration of the hammer stopper 41 is the same as the stoppers 7, 8. Since such a bent shape can improve the rigidity of the mass 42, the deflection of the mass 42 can be further restrained when the hammer 6 comes into contact, thereby further reducing the amount of displacement of the stopper 41 and consequently further improving the touch feeling.

As appreciated, the present invention is not limited to the described embodiment, but can be practiced in a variety of implementations. For example, in the embodiment, the first cushion 25 is described as harder than the second cushion 27, but the relationship of hardness between both cushions 25, 27 may be reversed, or both may be made to have the same hardness in order to ensure desired cushion characteristics. Also, while the stoppers 7, 8 are single continuous members, respectively, along the entire electronic piano, they may be divided in the lengthwise direction, and provided on an octave-by-octave basis. Further, other cushions may be laminated on the stoppers 7, 8 in addition to the first and second cushions 25, 27 in the embodiment. Also, the mass 26 may be made of another metal plate having a high rigidity and specific gravity or an appropriate material other than metal, instead of the illustrated steel plate. Further, while the present invention is applied to both the hammer stopper 7 and front key stopper 8, the present invention may be applied only to the hammer stopper 7 to which a relatively large impact acts.

Also, while the embodiment is an example of electronic piano, the present invention may be applied to restrictions of pivotal movements of keys of other types of keyboard-based musical instruments, for example, acoustic piano, hammers of pianos having a silence function, and may further be applied to restrictions of pivotal movements of other appropriate pivotable members, for example, a jack. Otherwise, details in configuration can be modified as appropriate within the spirit and scope of the present invention.

INDUSTRIAL AVAILABILITY

The stopper of the present invention improves a touch feeling by providing a good stopping feeling of pivotable members, and is extremely useful in restraining collision noise and other noise.

The invention claimed is:

1. A stopper for a keyboard-based musical instrument with which a pivotable member comes into contact while said pivotal member pivotally moves in association with a key touch, thereby restraining the pivotal movement of said pivotable member, said stopper comprising:

a highly rigid plate-like mass;

a first cushion laminated on a front side of said mass, said first cushion being made of a foamed urethane;

a second cushion laminated on a back side of said mass, said second cushion being made of the foamed urethane;

wherein the foamed urethane of the first cushion has a lower degree of foaming than the foamed urethane of the second cushion; and a holder mounted on a back side of said second cushion and holding said second cushion;

wherein a free end of the pivotal member comes into contact with only the stopper comprising the plate-like mass, the first cushion, and the second cushion;

and wherein with an impact from the pivotal member on the stopper, the highly rigid plate-like mass hardly deflects such that the impact distributes over a wide area of the second cushion through the mass as the impact is transmitted and such that a displacement on a back side of the first cushion is restrained by the mass.

2. A stopper for a keyboard-based musical instrument according to claim 1, characterized in that said mass is made of a metal.

3. A stopper for a keyboard-based musical instrument according to claim 1, characterized in that said first and second cushions are different in hardness from each other.

4. A stopper for a keyboard-based musical instrument according to claim 3, characterized in that said first cushion is harder than said second cushion.

5. A stopper for a keyboard-based musical instrument according to claim 1, characterized by further comprising a felt adhered on a surface closer to said first cushion.

6. A stopper for a keyboard-based musical instrument according to claim 1, characterized in that said first and second cushions and said mass extend in a direction in which said pivotable members are arranged side by side.

* * * * *